US012330040B1

(12) United States Patent
Raposo

(10) Patent No.: US 12,330,040 B1
(45) **Date of Patent: *Jun. 17, 2025**

(54) PUTTER-TYPE GOLF CLUB WITH ELECTRICAL COMPONENTS

(71) Applicant: Callaway Golf Company, Carlsbad, CA (US)

(72) Inventor: Mario Raposo, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 823 days.

This patent is subject to a terminal disclaimer.

(21) Appl. No.: 17/577,719

(22) Filed: Jan. 18, 2022

Related U.S. Application Data

(63) Continuation-in-part of application No. 17/523,649, filed on Nov. 10, 2021, which is a continuation-in-part of application No. 17/485,164, filed on Sep. 24, 2021, now Pat. No. 11,865,426, which is a continuation of application No. 17/162,072, filed on Jan. 29, 2021, now Pat. No. 11,344,785, which is a continuation of application No. 16/814,751, filed on Mar. 10, 2020, now Pat. No. 10,918,929, which is a continuation of application No. 16/509,232, filed on Jul. 11, 2019, now Pat. No. 10,688,366.

(Continued)

(51) Int. Cl.

| | |
|---|---|
| ***A63B 24/00*** | (2006.01) |
| ***A63B 37/00*** | (2006.01) |
| ***A63B 53/04*** | (2015.01) |
| ***A63B 69/36*** | (2006.01) |

(52) U.S. Cl.
CPC ..... *A63B 69/3658* (2013.01); *A63B 37/0022* (2013.01); *A63B 37/0051* (2013.01); *A63B 69/3655* (2013.01); *A63B 2220/34* (2013.01); *A63B 2220/833* (2013.01)

(58) Field of Classification Search
CPC ..... A63B 24/0003; A63B 24/0006; A63B 24/0012; A63B 2024/0018; A63B 24/0021; A63B 2024/0028; A63B 2024/0031; A63B 2024/0034; A63B 2024/004; A63B 2024/0043; A63B 2024/0046; A63B 2024/0056; A63B 53/04; A63B 69/3614; A63B 69/362; A63B 69/3632; A63B 69/3685
See application file for complete search history.

(56) References Cited

U.S. PATENT DOCUMENTS

| | | | | |
|---|---|---|---|---|
| 7,338,387 | B2 * | 3/2008 | Nycum | A63B 60/02 473/332 |
| 7,887,440 | B2 * | 2/2011 | Wright | A63B 69/3632 473/223 |

(Continued)

FOREIGN PATENT DOCUMENTS

| | | | | |
|---|---|---|---|---|
| AU | 2004207473 | A1 * | 8/2004 | A63B 24/0021 |
| WO | WO-2004067109 | A2 * | 8/2004 | A63B 24/0021 |

*Primary Examiner* — Alvin A Hunter
(74) *Attorney, Agent, or Firm* — Michael A. Catania

(57) ABSTRACT

A putter-type golf club comprising an electrical component is disclosed herein. The electrical component comprises an integrated circuit having a gyroscope, a magnetometer, and a BLUETOOTH low energy (BTLE) radio, and at least one battery. A body is composed of an epoxy material, and the body encompasses the electrical component.

4 Claims, 17 Drawing Sheets

Related U.S. Application Data

(60) Provisional application No. 62/697,584, filed on Jul. 13, 2018.

(56) References Cited

U.S. PATENT DOCUMENTS 8,465,376 B2 * 6/2013 Bentley ..... A63B 24/0006 473/226
8,696,482 B1 * 4/2014 Pedenko ..... A63B 24/0003 473/223
8,903,521 B2 * 12/2014 Goree ..... A63B 69/3632 700/90
8,905,855 B2 * 12/2014 Fitzpatrick ..... G06T 13/40 473/199
9,597,567 B1 * 3/2017 Tran ..... A63B 71/06
9,661,894 B2 * 5/2017 Niegowski ..... A63B 37/0003
9,943,744 B2 * 4/2018 Meadows ..... G09B 19/0038
2004/0142766 A1 * 7/2004 Savarese ..... A63B 37/0003 473/353
2004/0204257 A1 * 10/2004 Boscha ..... A63B 60/42 473/131
2006/0084527 A1 * 4/2006 Nycum ..... A63B 60/02 473/350
2006/0128503 A1 * 6/2006 Savarese ..... A63B 43/00 473/353
2009/0029754 A1 * 1/2009 Slocum ..... A63B 24/0087 463/32
2009/0111602 A1 * 4/2009 Savarese ..... G01S 19/19 473/283
2012/0142452 A1 * 6/2012 Burnett ..... A63B 53/0475 473/345
2014/0277630 A1 * 9/2014 Meadows ..... G09B 19/0038 700/91
2015/0057111 A1 * 2/2015 Tremblay-Munger ..... G06F 3/0346 473/446
2015/0362331 A1 * 12/2015 Sanchez ..... A63B 53/14 702/153
2017/0144022 A1 * 5/2017 Glenn ..... A61B 5/6895

* cited by examiner

PUTTER-TYPE GOLF CLUB WITH ELECTRICAL COMPONENTS

CROSS REFERENCES TO RELATED APPLICATIONS

The Present Application is a continuation-in-part application of U.S. patent application Ser. No. 17/523,649, filed on Nov. 10, 2021, which is a continuation-in-part application of U.S. patent application Ser. No. 17/485,164, filed on Sep. 24, 2021, which is a continuation application of U.S. patent application Ser. No. 17/162,072, filed on Jan. 29, 2021, which is a continuation application of U.S. patent application Ser. No. 16/814,751, filed on Mar. 10, 2020, now U.S. patent Ser. No. 10/918,929, issued on Feb. 16, 2021, which is a continuation application of U.S. patent application Ser. No. 16/509,232, filed on Jul. 11, 2019, now U.S. patent Ser. No. 10/688,366, issued on Jun. 23, 2020, which claims priority to U.S. Provisional Patent Application No. 62/697,584, filed on Jul. 13, 2018, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to golf clubs. Particularly to putters with internal electronics.

Description of the Related Art

Sensors have previously been placed within golf clubs to convey data about a golfer's swing.

Manwaring et al., U.S. Pat. No. 9,333,390 for a Golf Club Head With Adjustable Center of Gravity And Diagnostic Features discloses the use of electronic diagnostic inserts positioned within an interior tube of the club head.

Raposo, U.S. Pat. No. 8,992,346 for a Method And System For Swing Analysis discloses the positioning of a sensor within a grip of a golf club.

Ehlers et al., U.S. Pat. No. 9,050,519 for a System And Method For Shot Tracking discloses positioning a sensor in a shaft in each golf club of a set of golf clubs for shot tracking during a round of golf.

Denton et al., U.S. Pat. No. 9,079,088 for a Method And System For Shot Tracking discloses positioning a sensor in a top end of a grip of golf club for shot tracking.

Balardeta et al., U.S. Pat. No. 8,845,459 for a Method And System For Shot Tracking discloses positioning a sensor in a top end of a grip of golf club for shot tracking.

BRIEF SUMMARY OF THE INVENTION

One aspect of the present invention is a golf club head comprising a sensor weight comprising an epoxy sphere, a core layer and a cover layer. The epoxy sphere comprises a body and an electronic component. The electronic component comprises a plurality of stacked circuit boards and at least one battery disposed within the plurality of stacked circuit boards. The body is composed of an epoxy material. The body encompasses the electronic component.

By placing a magnetometer in the putter, the exact impact values are recorded.

The sensor weight preferably creates a compact design due to the circuit board composed of a flexible material, such that the circuit board is wrapped around the batteries.

Another important aspect of the present invention is that the circuit board attaches directly to the battery using three contact points: one positive pad and two negative contacts, including the actual crystal cover.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The main advantage to the consumer will be a golf club that records exact impact values, achieved by placing a magnetometer in the golf club.

The entire circuitry is preferably inside a hard plastic molded sphere.

Data is transferred via BLE radio to a mobile device (in this case a phone).

The circuitry inside the club preferably activates at impact using a shock switch for power savings. At rest, after the shot, the club keeps sending the data and going back to sleep mode every second until the user acknowledges it in the application on the user's mobile device.

Internal circuitry is embedded within the golf club head. The internal circuitry comprises at least a BLUETOOTH Low Energy radio (5th generation), a processor, a magnetometer, an accelerometer, and a battery. The internal circuit may also have a memory. A KIONIX chip is preferred. The $5^{th}$ generation BLUETOOTH Low Energy radio has a range of at least 700 meters. The battery is preferably a 2032 coin cell. A NF52 Nordic processor is preferably utilized. A KIONIX 3-axis accelerometer is preferably utilized.

Figure 1:
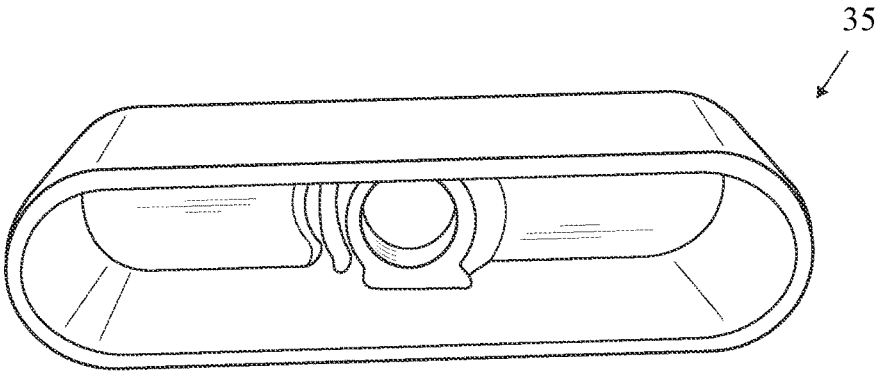
FIG. 1 is an isolated view of a weight.
Figure 2:
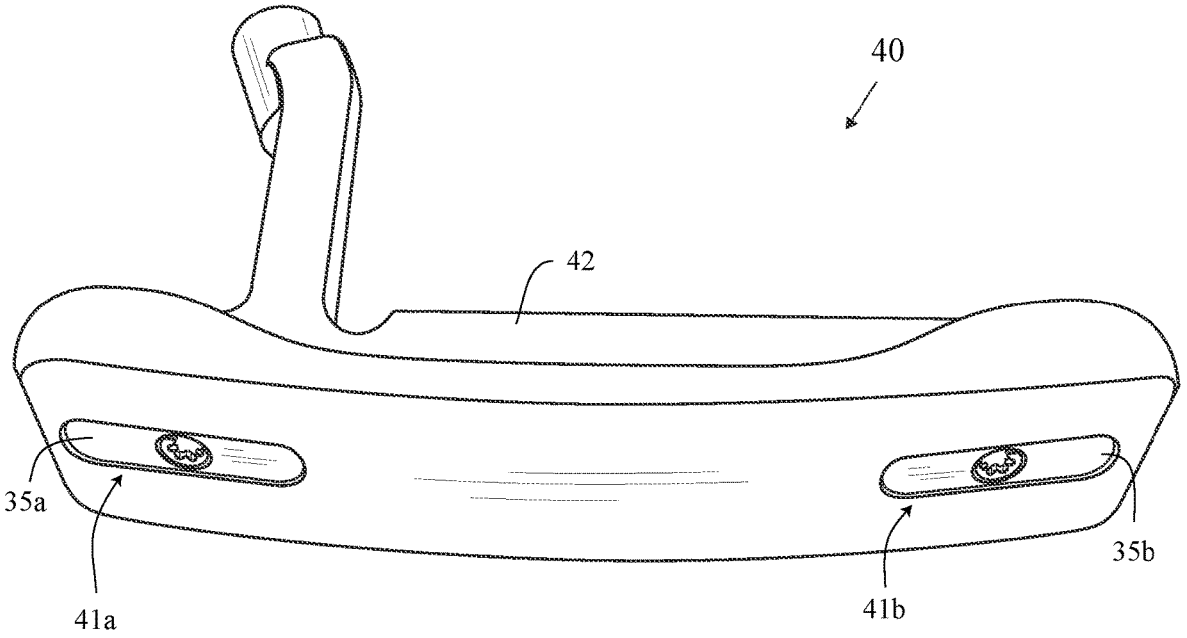
FIG. 2 is a bottom perspective view of a golf putter head.

FIGS. 1 and 2 show a sensor weight 35 and a golf putter head 40. The sensor weight 35 (shown empty in FIG. 1) houses the sensor 20. The golf putter head 40 comprises a body 42 having a volume ranging from 100 CC to 465 cc. The body 42 has an aperture(s) 41*a*-41*b* and a sensor(s), enclosed within the sensor weight(s) 35*a*-35*b*, positioned within the aperture(s) 41*a*-41*b*.

Figure 6:
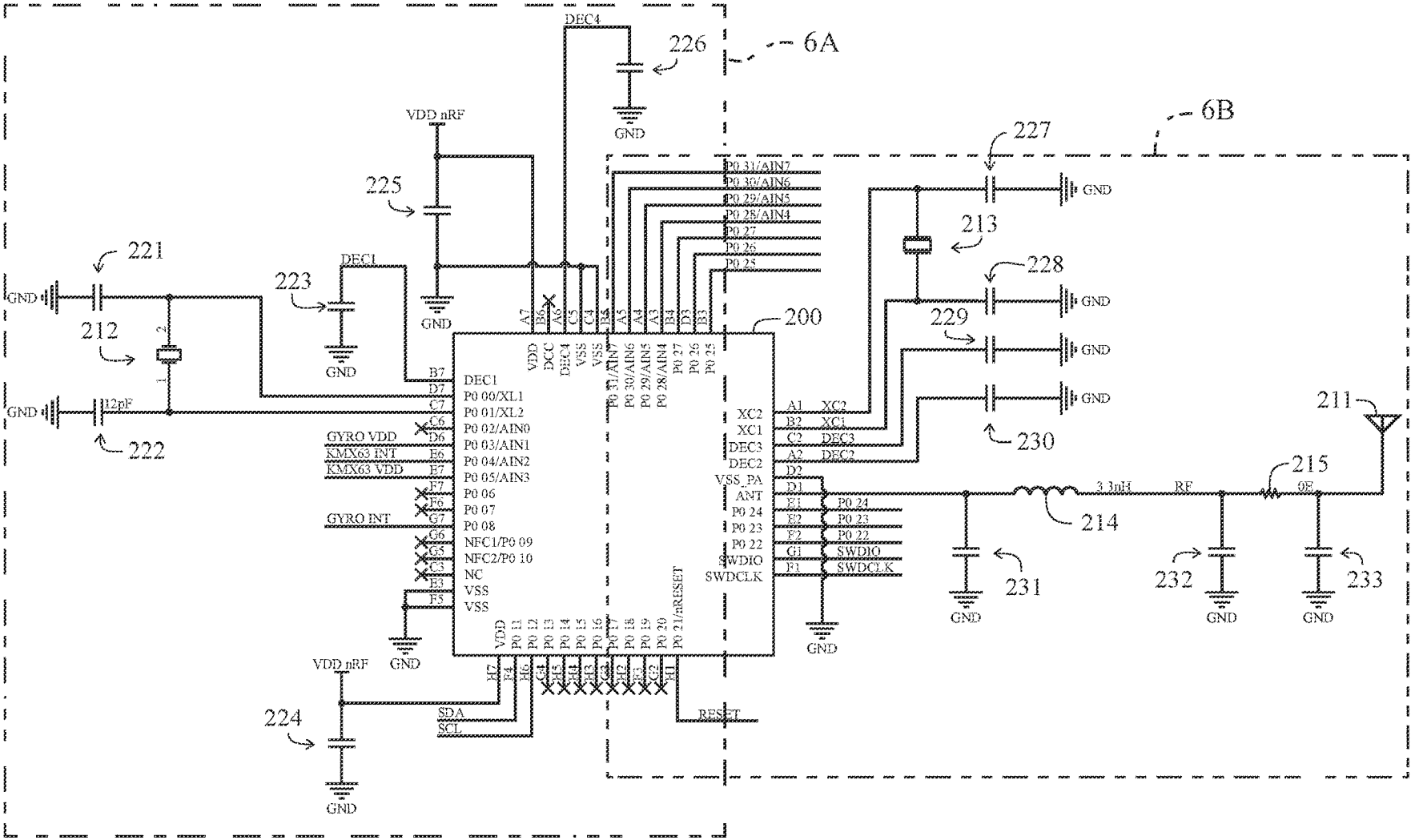
FIG. 6 is a circuit diagram.
Figure 6A:
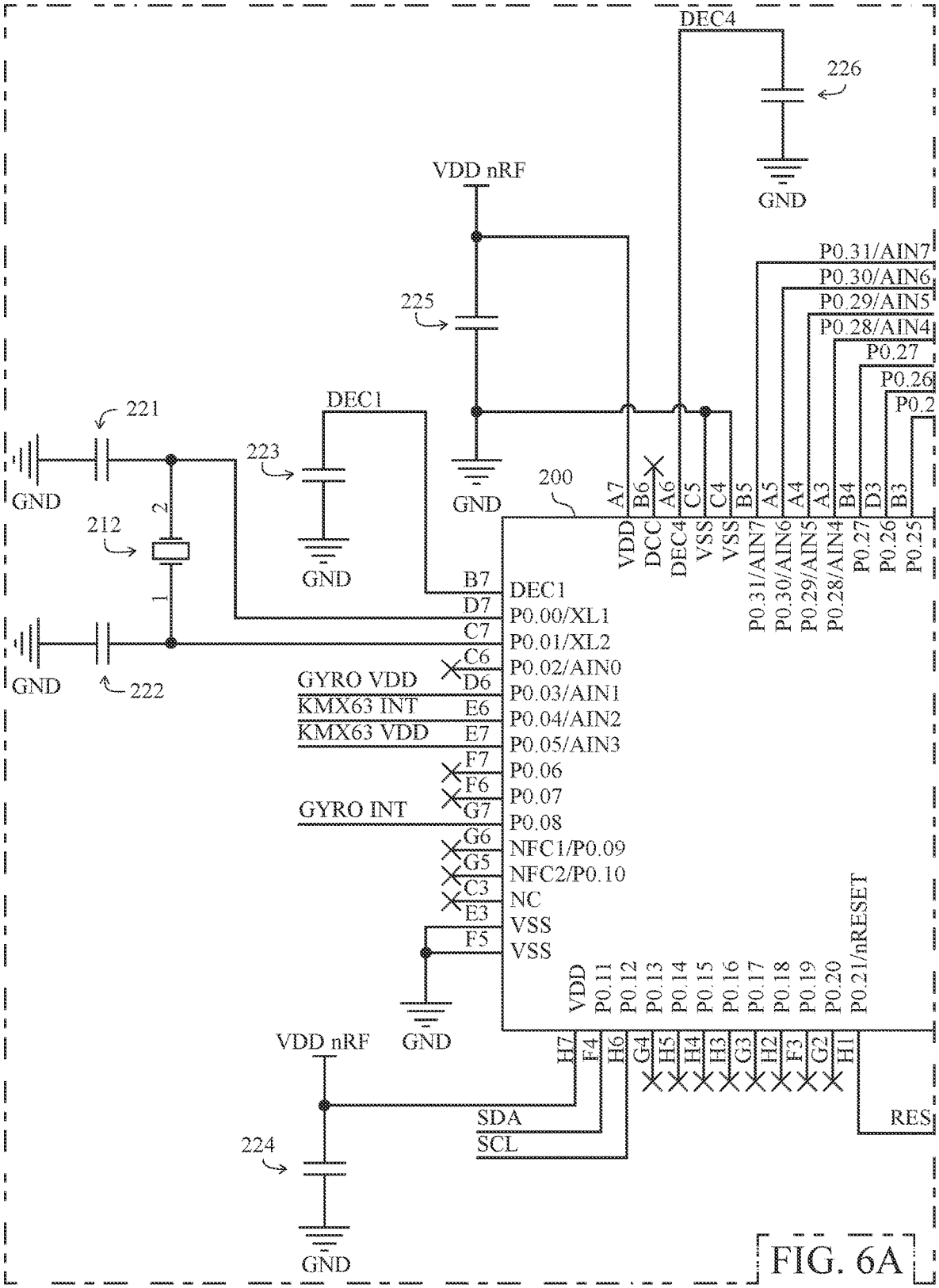
FIG. 6A is a circuit diagram.
Figure 6B:
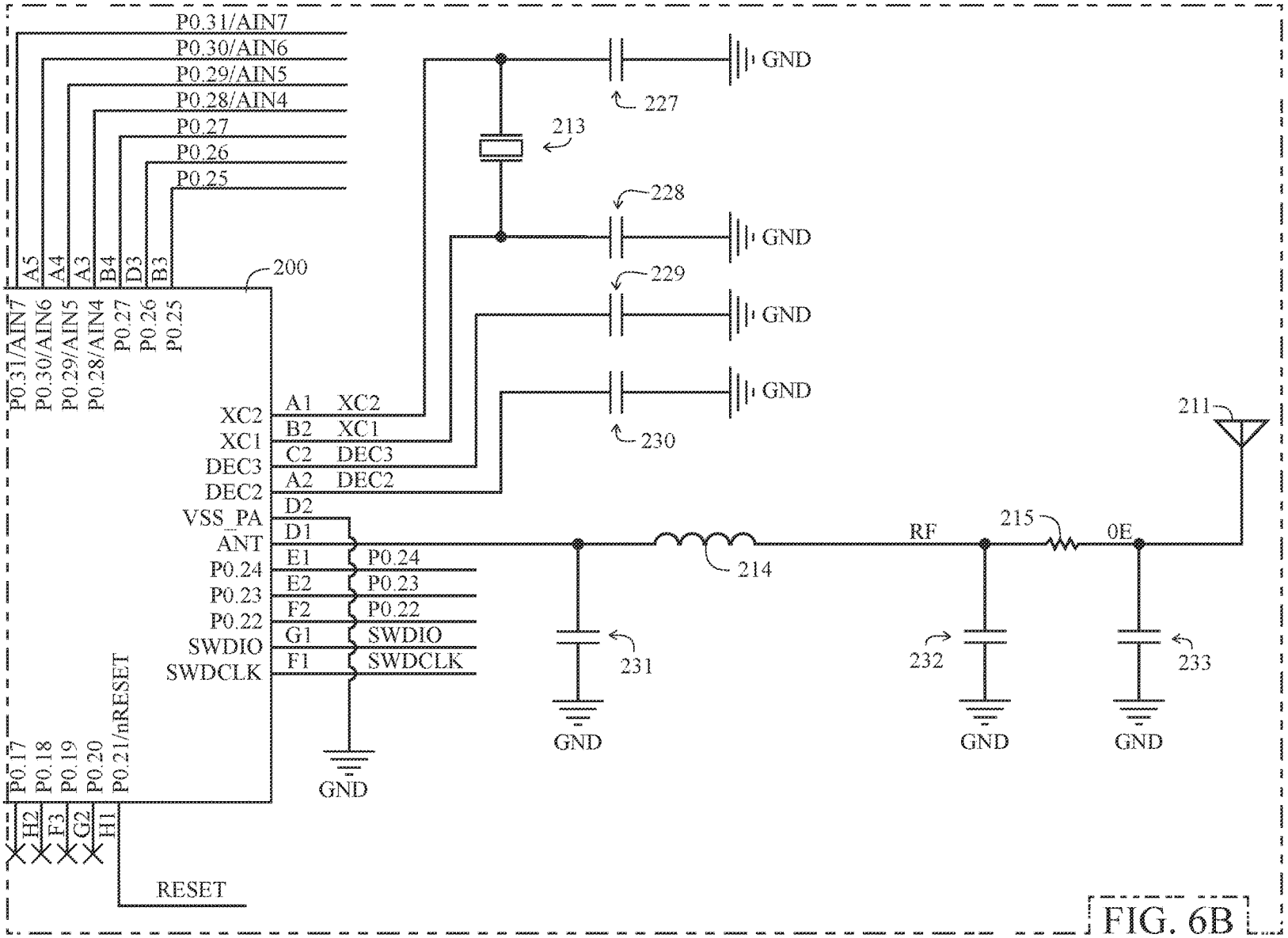
FIG. 6B is a circuit diagram.
Figure 13:
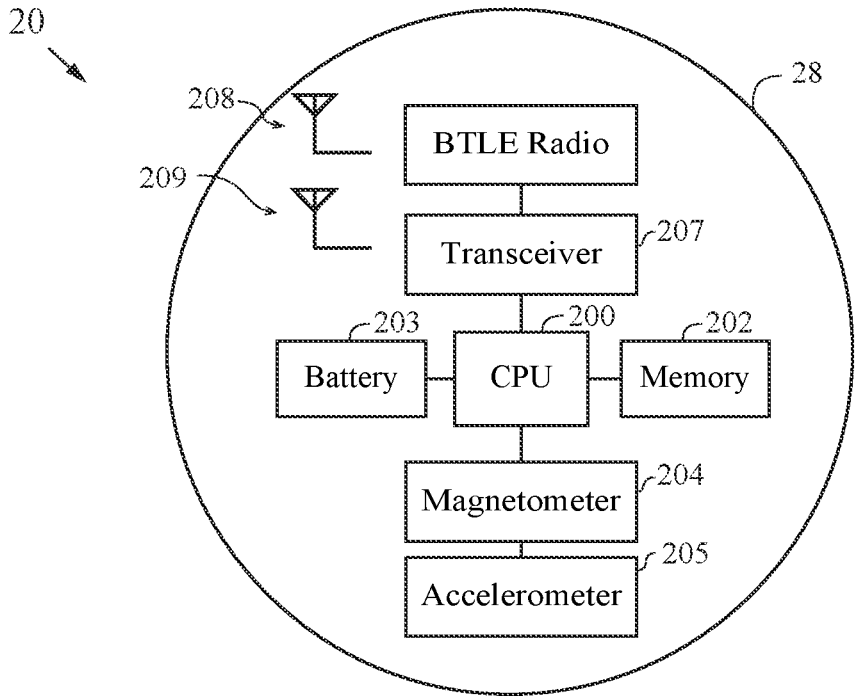
FIG. 13 is block diagram of components of a sensor.

The sensor 20, as shown in FIG. 13, preferably comprises a flexible circuit board comprising a BLUETOOTH antenna 208, a 1 GigaHertz antenna 209, a magnetometer 204, an accelerometer 205, a microcontroller 200, a radiofrequency transceiver 207, at least one inductor 214 and a plurality of capacitors 221-233 (as shown in FIGS. 6A-6B), and at least one battery 203. The battery or batteries preferably contact the flexible circuit board at three contact points.

Figure 3A:
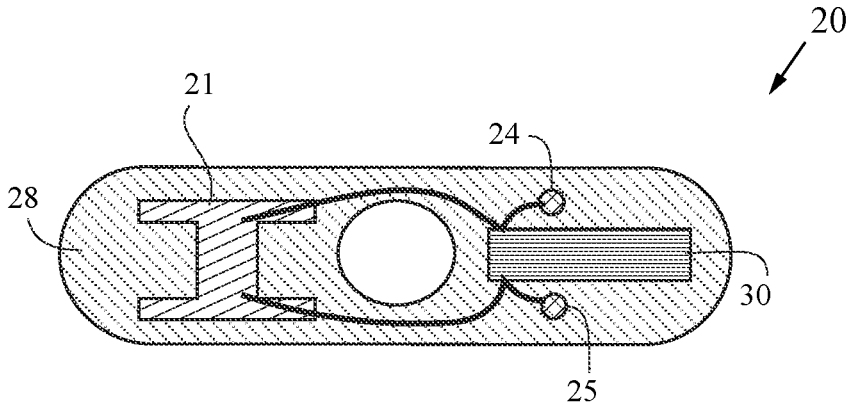
FIG. 3A is a cross-sectional top view of a sensor.
Figure 3B:
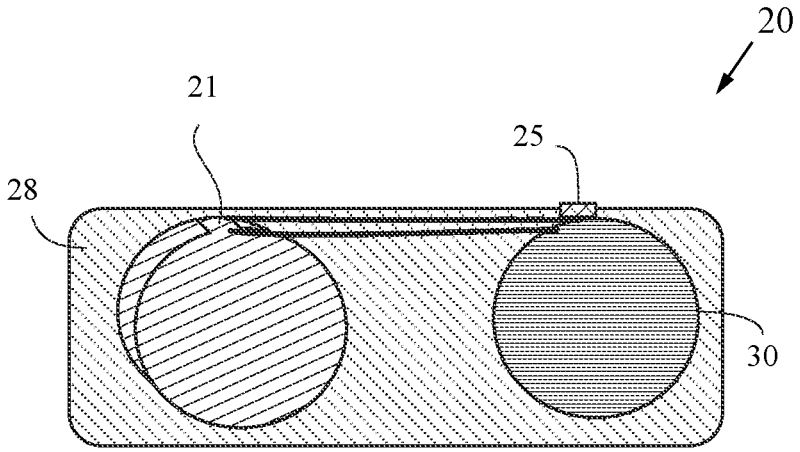
FIG. 3B is a cross-sectional side view of a sensor.

FIGS. 3A (top view) and 3B (side view) show a cross-sectional view of a sensor 20 enclosed in a main sensor body 28. The sensor 20 comprises a folded circuitry housing 21, charging pins 24 and 25, and a battery 30.

Figure 4A:
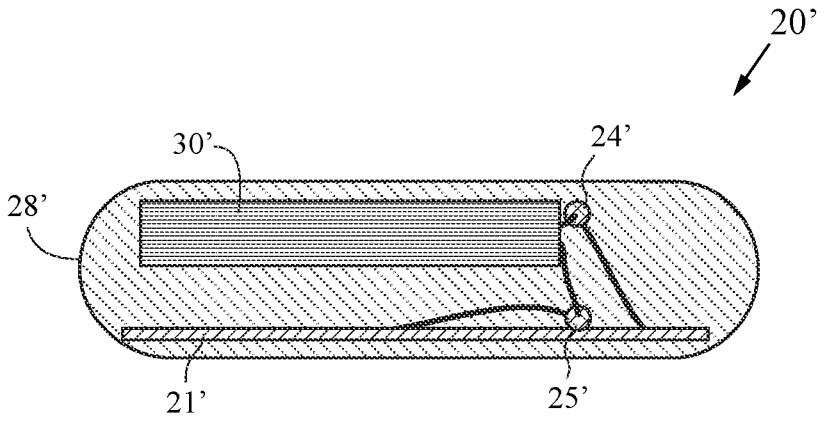
FIG. 4A is a cross-sectional top view of a sensor.
Figure 4B:
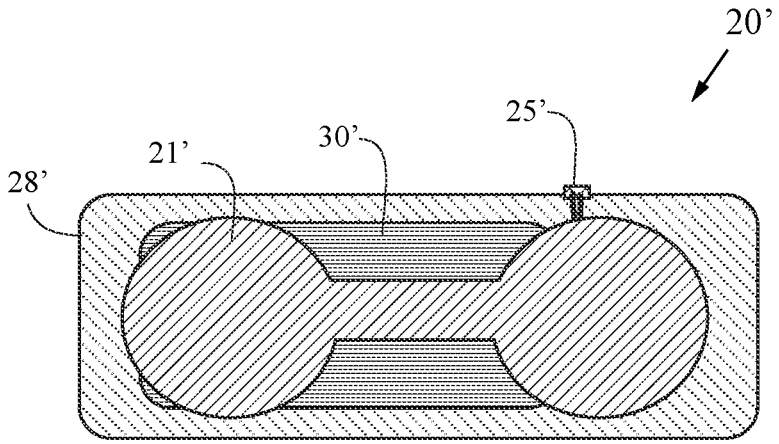
FIG. 4B is a cross-sectional side view of a sensor.

FIGS. 4A (top view) and 4B (side view) show an alternative embodiment of the present invention. A cross-sectional view of a sensor 20' enclosed in a main sensor body 28' is shown. The sensor 20' comprises a circuitry housing 21', charging pins 24' and 25', and a battery 30'.

Figure 5:
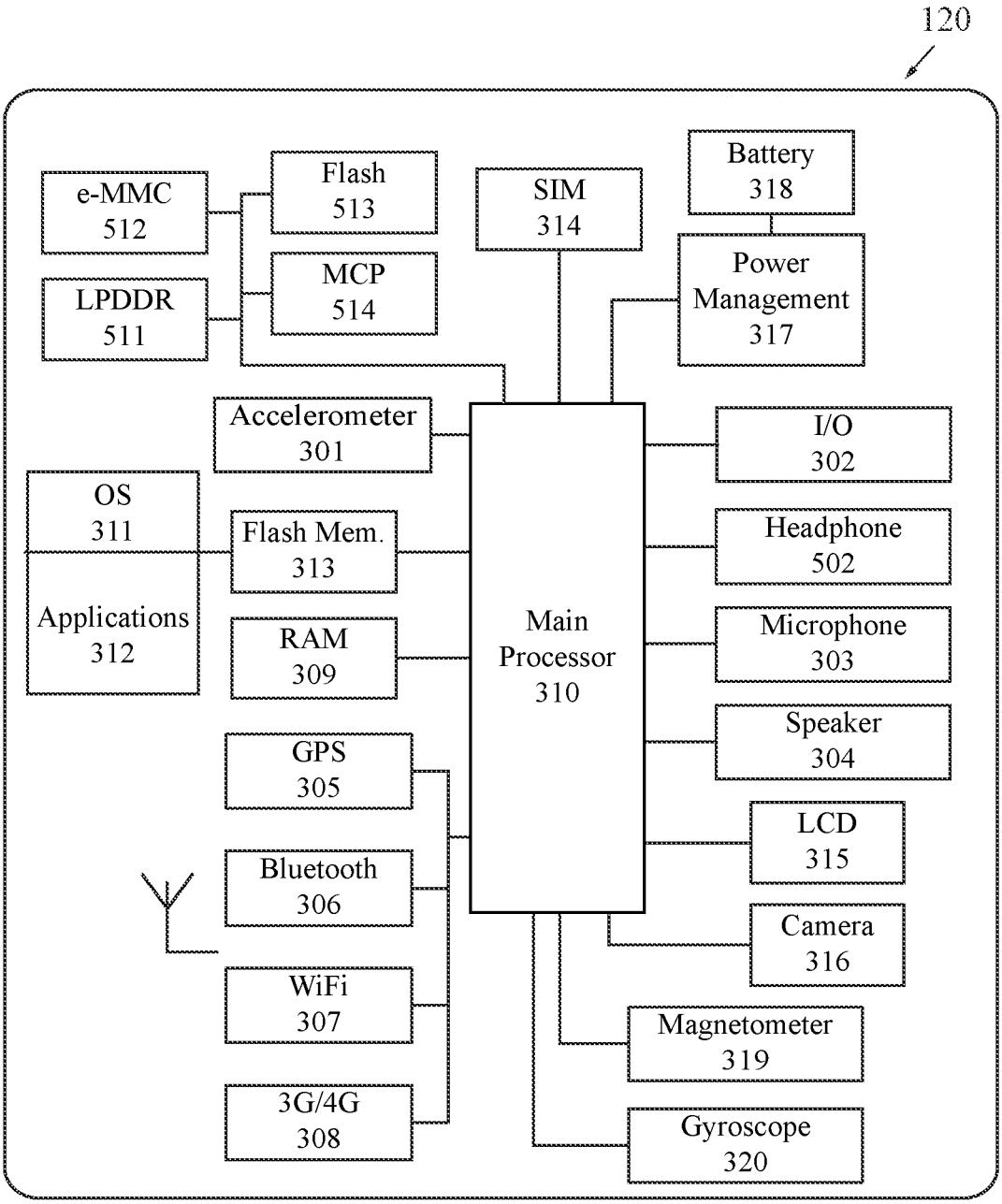
FIG. 5 is a block diagram of components of a mobile device.

FIG. 5 is a block diagram of components of a mobile device 120. The mobile device 120 preferably comprises an accelerometer 301, an input/output module 302, a microphone 303, a speaker 304, a GPS 305, a BLUETOOTH transceiver 306, a WiFi transceiver 307, a 3G/4G transceiver 308, a RAM memory 309, a main processor 310, an operating system (OS) module 311, an applications module 312, a flash memory 313, a SIM card 314, a LCD display 315, a camera 316, a power management module 317, a battery 318, a magnetometer 319, a gyroscope 320*a* LPDDR module 511, a e-MMC module 512, a flash module 513, and a MCP module 514.

FIGS. 6, 6A and 6B illustrate circuit diagrams of the internal circuitry of the golf putter head 40. FIGS. 6A and 6B are detailed views of the circuit diagram of FIG. 6. The internal circuitry preferably includes a CPU 200, an antenna 211, a first crystal oscillator 212, a second crystal oscillator (XTAL SMD 2016, 32 MHz) 213, an inductor (3.3 nH) 214, a resistor 215, a first capacitor (12 picoFaradays "pF") 221, a second capacitor (12 pF) 222, a third capacitor (100 nano Faradays "nF") 223, a fourth capacitor (100 nF) 224, a fifth capacitor (4.7 microFaradays "uF") 225, a sixth capacitor (100 nF) 226, a seventh capacitor (12 pF) 227, an eighth capacitor (12 pF) 228, a ninth capacitor (100 pF) 229, a tenth capacitor (100 pF) 230, an eleventh capacitor (100 nF) 231, a twelfth capacitor (NS) 232, and a thirteenth capacitor (NS) 233.

Figure 6C:
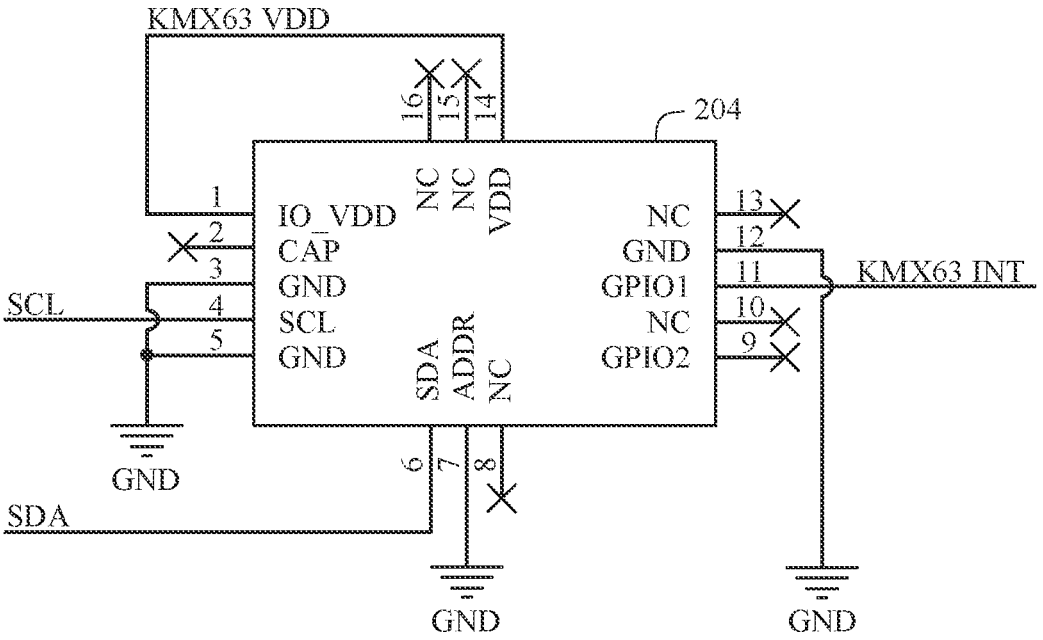
FIG. 6C is a circuit diagram.

FIG. 6C is a circuit diagram of a magnetometer/accelerometer 204, preferably a medium-G, wide bandwidth tri-axis magnetometer/tri-axis accelerometer.

Figure 6D:
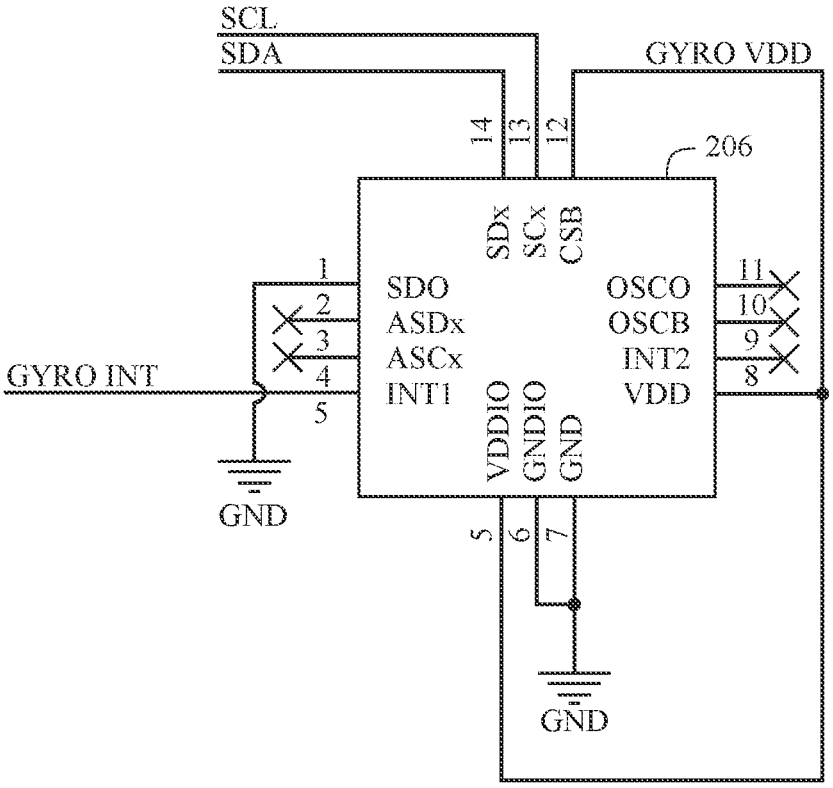
FIG. 6D is a circuit diagram.

FIG. 6D is a circuit diagram for a gyroscope 206, preferably a BOSCH SENSORTEC BMG250 gyroscope.

Figure 6E:
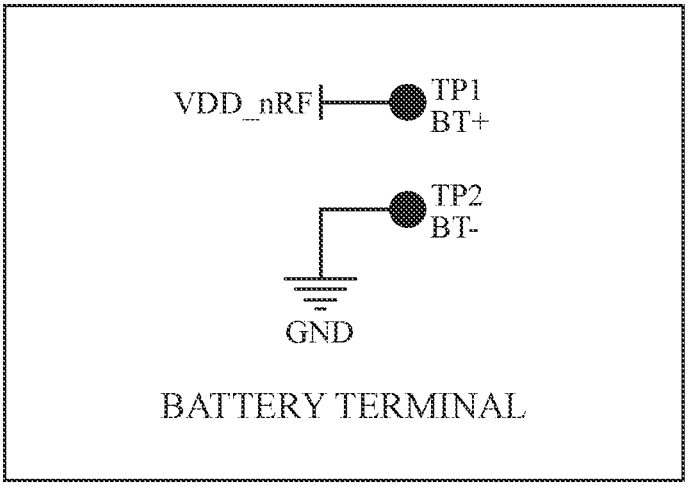
FIG. 6E is a circuit diagram.

FIG. 6E is a circuit diagram of a battery terminal.

Figure 6F:
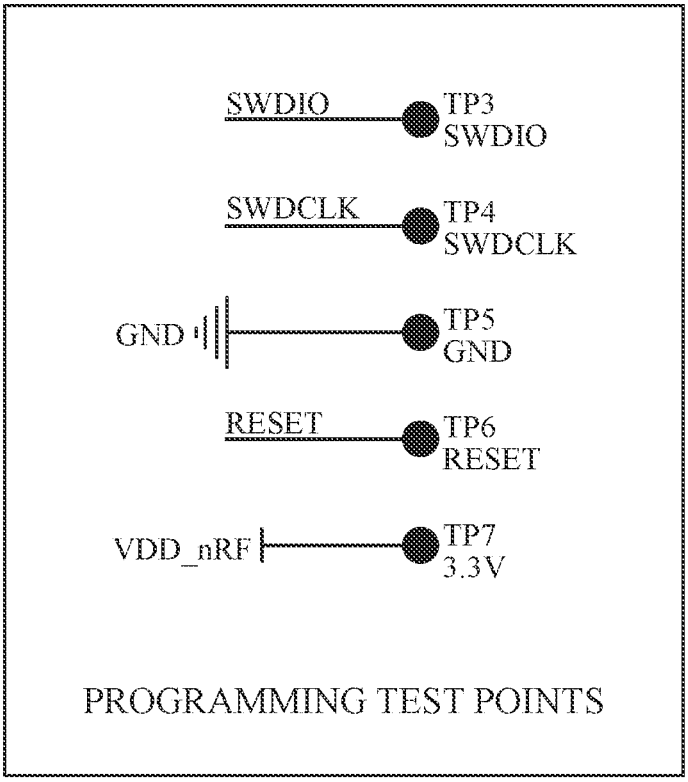
FIG. 6F is a circuit diagram.

FIG. 6F is a circuit diagram of programming test points.

Figure 7:
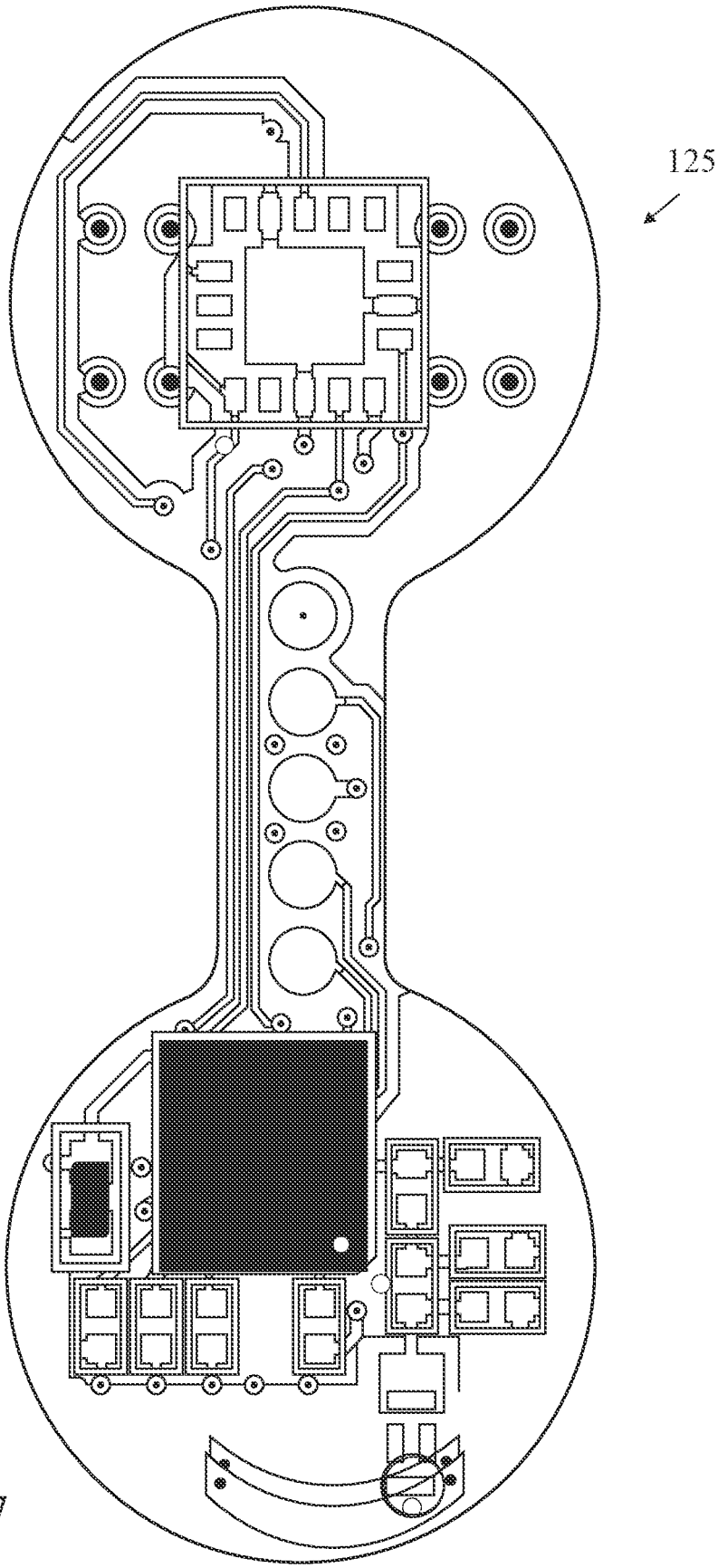
FIG. 7 is a top plan view of a flexible circuit board.
Figure 8:
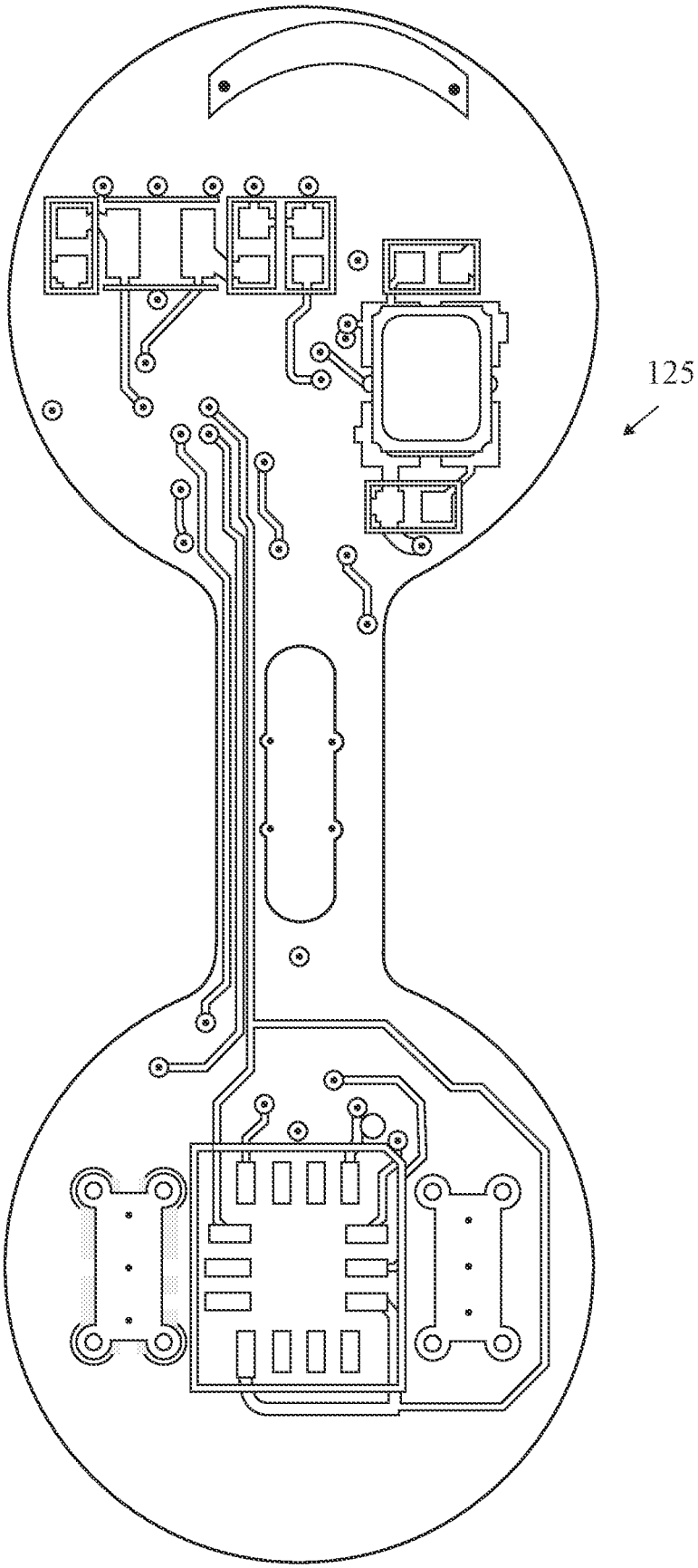
FIG. 8 is a bottom plan view of a flexible circuit board.

FIG. 7 is a top plan view of a flexible circuit board 125. FIG. 8 is a bottom plan view of a flexible circuit board 125.

Figure 9:
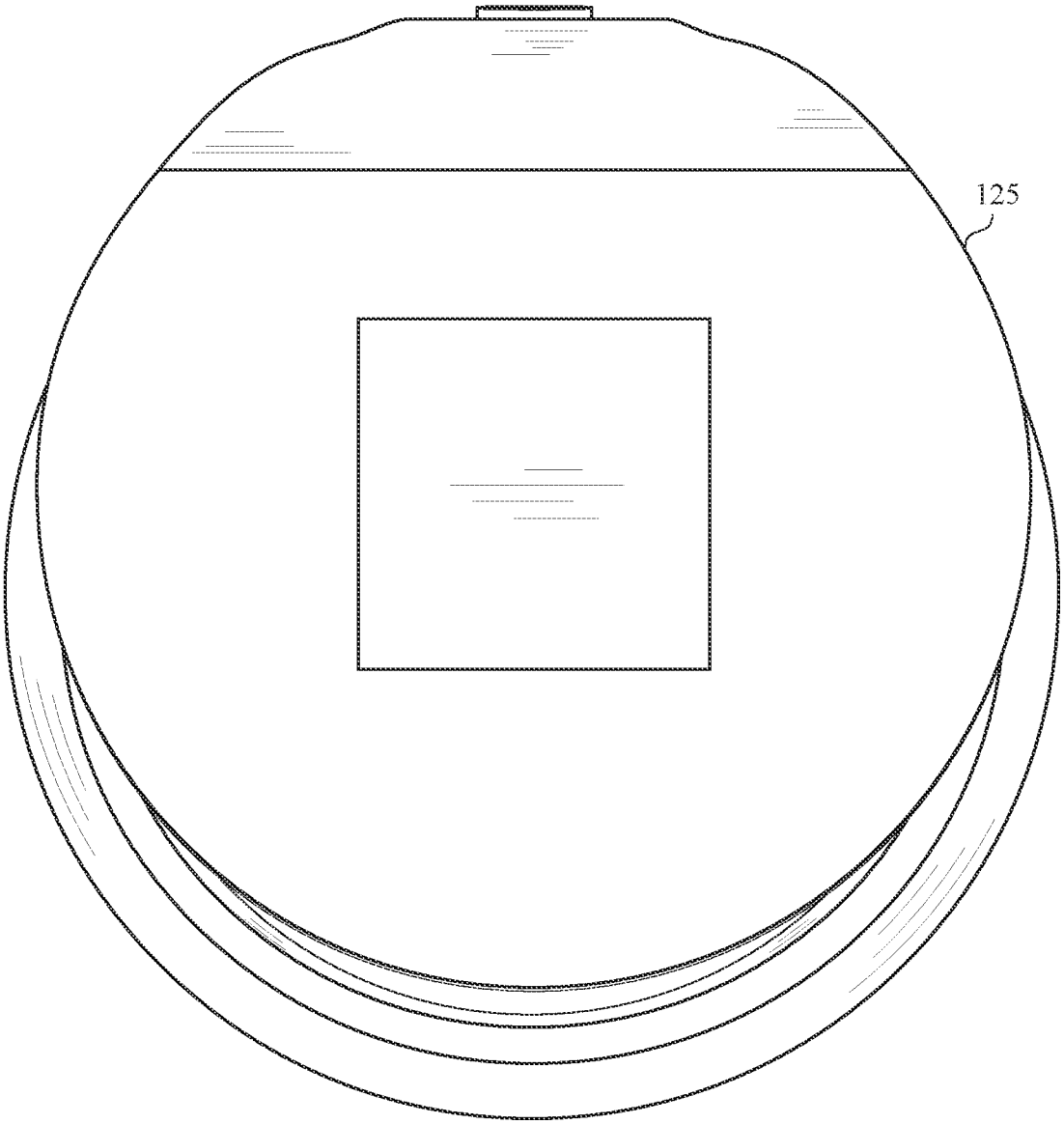
FIG. 9 is an illustration of a folded flexible circuit board.
Figure 10:
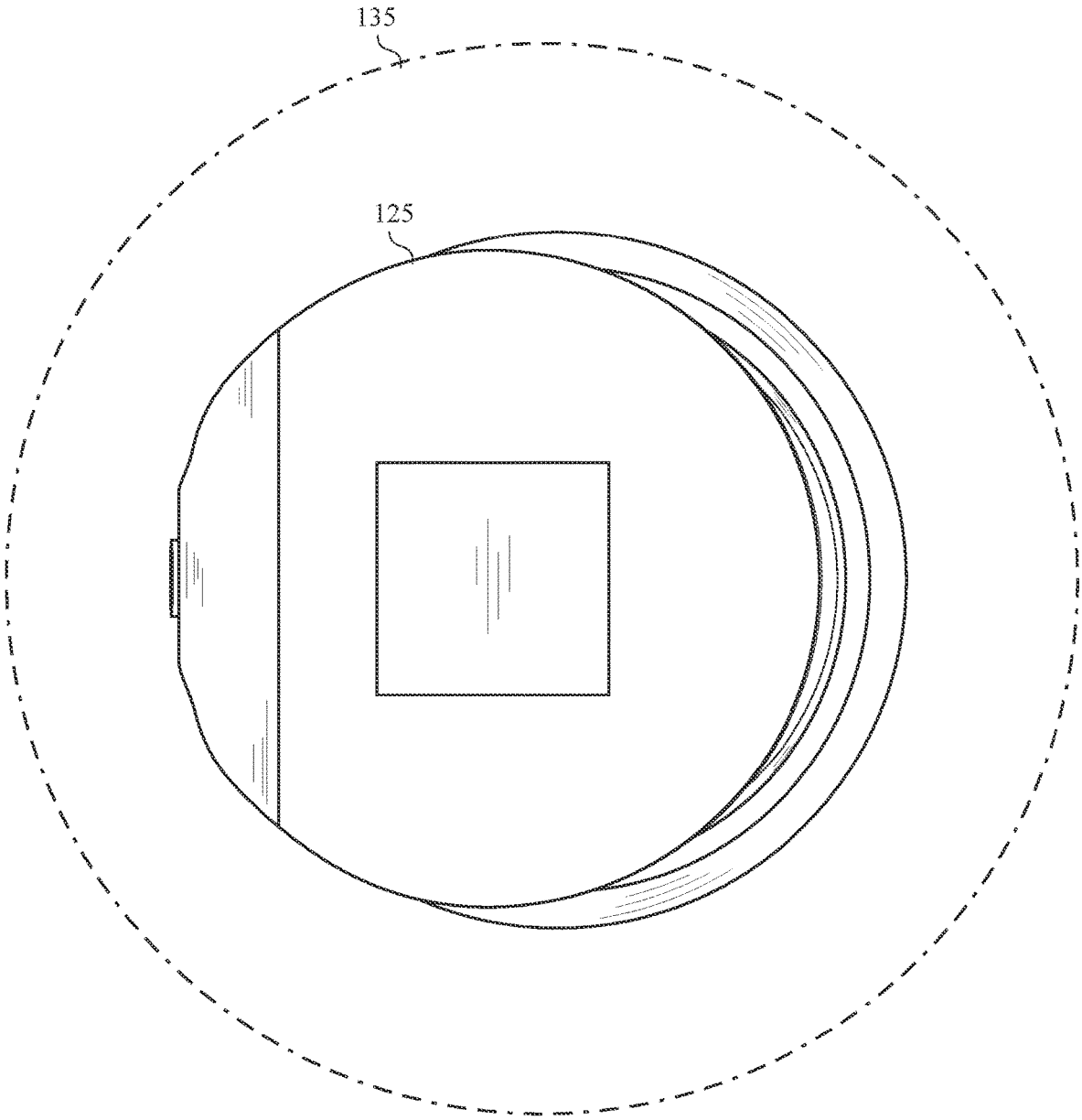
FIG. 10 is an illustration of a folded flexible circuit board within an epoxy sphere.

FIG. 9 shows a folded flexible circuit board 125. FIG. 10 shows the circuit board 125 enclosed within an epoxy sphere core 135.

Figure 11:
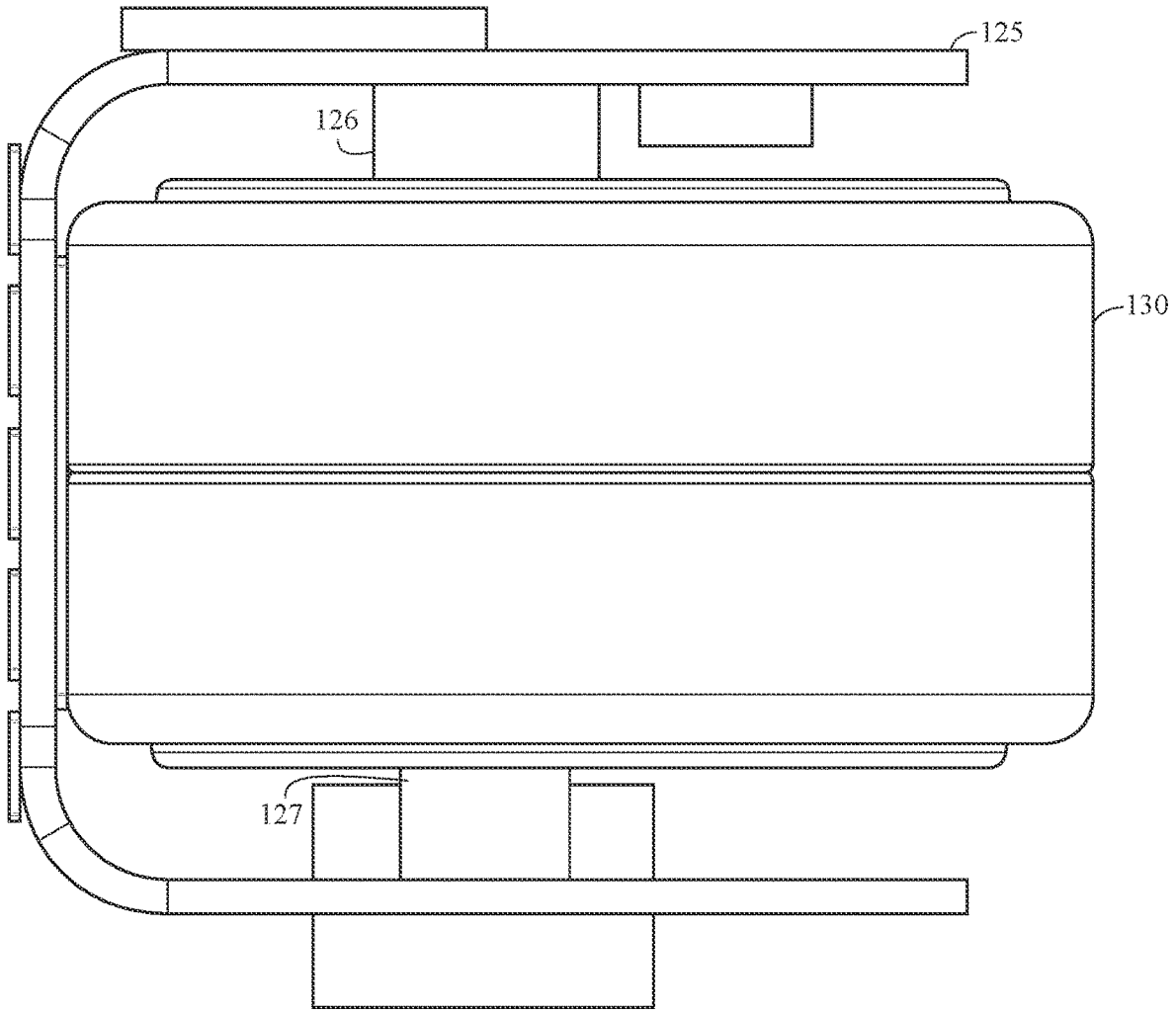
FIG. 11 is an illustration of a flexible circuit board wrapped around multiple batteries and connected by multiple contacts.

FIG. 11 shows a flexible circuit board 125 wrapped around multiple batteries 130 and connected to the batteries 130 by contacts 126 and 127.

Figure 12:
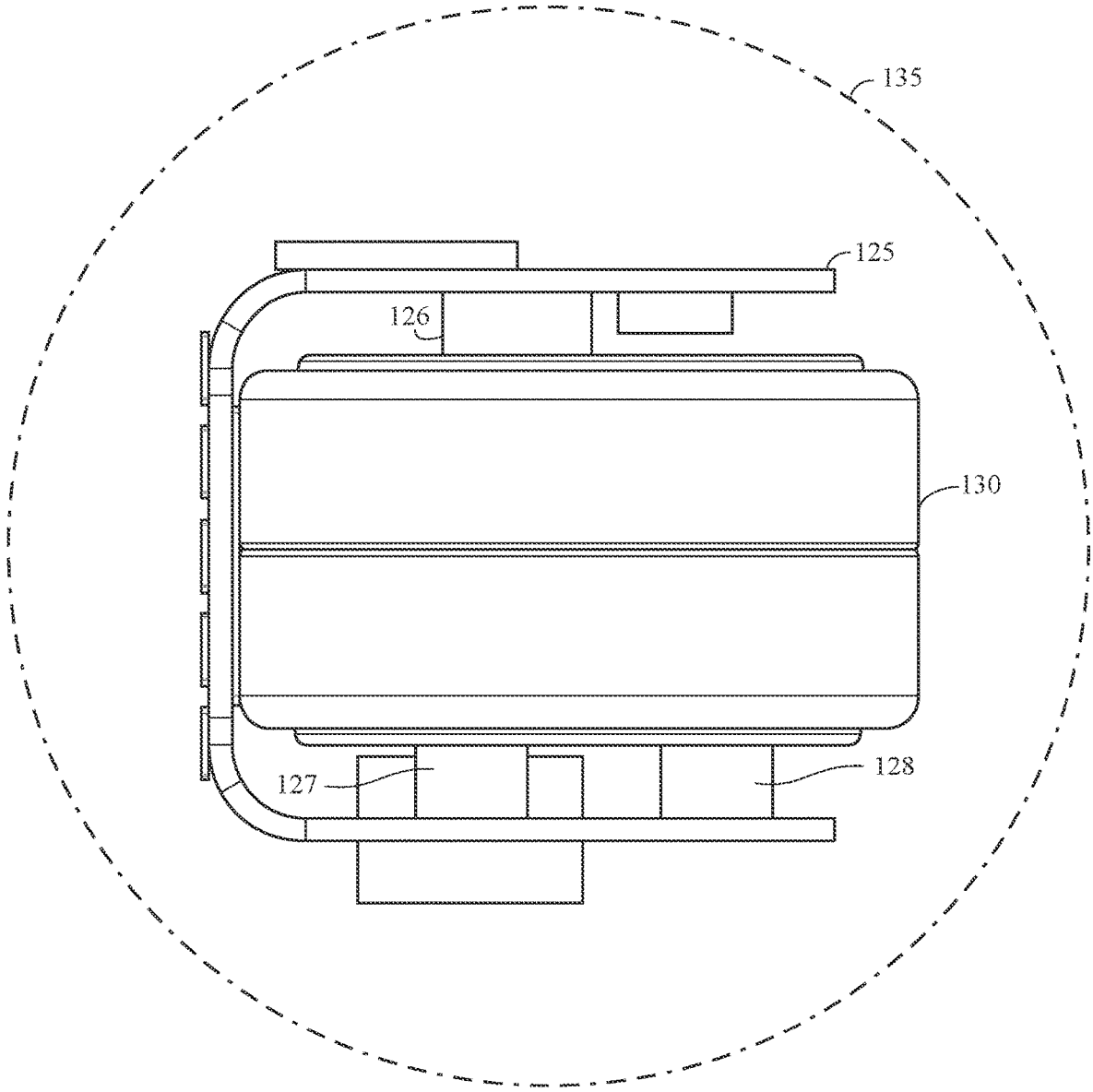
FIG. 12 is an illustration of a flexible circuit board wrapped around multiple batteries and connected by multiple contacts, and within an epoxy sphere.

FIG. 12 shows a flexible circuit board 125 wrapped around multiple batteries 130 and connected to the batteries 130 by three contacts 126, 127, and 128. The circuit board 125 is shown enclosed within an epoxy sphere core 135.

Figure 14:
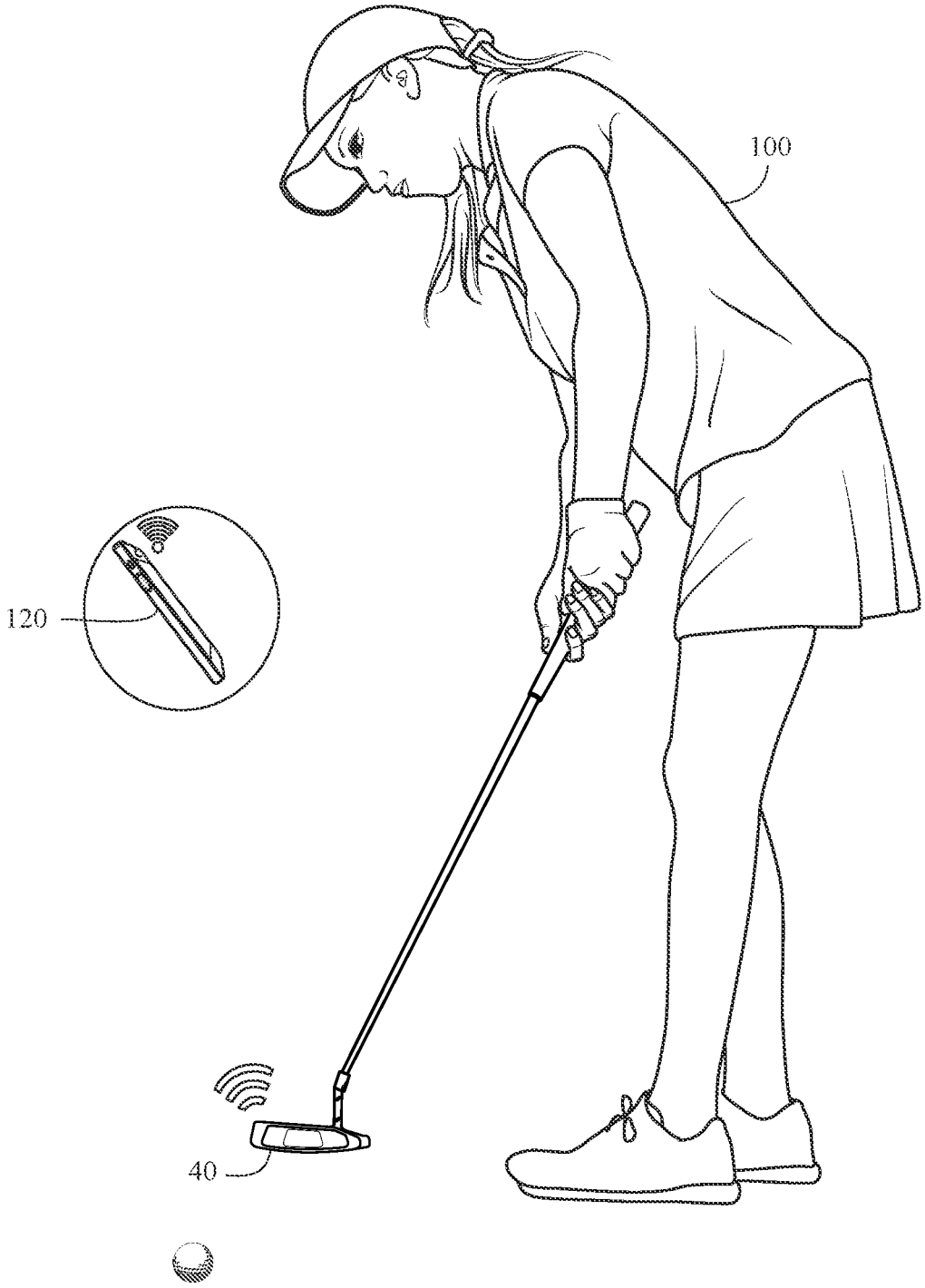
FIG. 14 is an illustration of a user swinging a golf putter comprising a sensor weight.

As shown in FIG. 14, a golfer 100 swings a golf putter to hit a golf ball. The putter head 40 houses internal circuitry according to the present invention therein. A mobile device 120, such as a mobile phone, receives a BLUETOOTH low energy wireless communication transmission from the golf putter head 40.

The flexible circuit board of the golf equipment preferably has a width ranging from 5 to 20 mm, a height ranging from 5-20 mm and a length ranging from 5-20 mm.

The radiofrequency transceiver is preferably a BLUETOOTH Low Energy radio.

The flexible circuit board preferably further comprises a memory 202, and is preferably wrapped around at least one battery.

The electrical component preferably detects the impact and transmits a signal to a mobile device.

Manwaring et al., U.S. Pat. No. 9,333,390 for a Golf Club Head With Adjustable Center of Gravity And Diagnostic Features is hereby incorporated by reference in its entirety.

Raposo, U.S. Pat. No. 8,992,346 for a Method And System For Swing Analysis is hereby incorporated by reference in its entirety.

Ehlers et al., U.S. Pat. No. 9,050,519 for a System And Method For Shot Tracking is hereby incorporated by reference in its entirety.

Denton et al., U.S. Pat. No. 9,079,088 for a Method And System For Shot Tracking is hereby incorporated by reference in its entirety.

Balardeta et al., U.S. Pat. No. 8,845,459 for a Method And System For Shot Tracking is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A putter-type golf club comprising:

a body comprising a front face and rear cavity;

a sensor positioned within the rear cavity, the sensor comprising a flexible circuit board comprising a BLUETOOTH antenna, an antenna, a magnetometer, an accelerometer, a microcontroller, a radiofrequency transceiver, at least one inductor and a plurality of capacitors, wherein the flexible circuit board has a width ranging from 5 to 20 mm, a height ranging from 5-20 mm and a length ranging from 5-20 mm;

at least one battery, wherein the at least one battery contacts the flexible circuit board at three contact points.

2. The putter-type golf club according to claim 1 wherein the radiofrequency transceiver is a BLUETOOTH Low Energy radio.

3. The putter-type golf club according to claim 1 wherein the flexible circuit board further comprises a memory.

4. A putter-type golf club comprising:

a body comprising a front face and rear cavity;

a sensor positioned within the rear cavity, the sensor comprising a flexible circuit board comprising a BLUETOOTH antenna, an antenna, a magnetometer, an accelerometer, a microcontroller, a radiofrequency transceiver, at least one inductor and a plurality of capacitors; and at least one battery, wherein the at least one battery contacts the flexible circuit board at three contact points; wherein the flexible circuit board is wrapped around the at least one battery.

* * * * *